US006961022B1

(12) United States Patent
Tay et al.

(10) Patent No.: US 6,961,022 B1
(45) Date of Patent: Nov. 1, 2005

(54) ANTENNA RADIATOR ASSEMBLY AND RADIO COMMUNICATIONS DEVICE

(75) Inventors: Yew Siow Tay, Singapore (SG); Guan Hong Ng, Singapore (SG); Yu Chee Tan, Singapore (SG); Kok Kiong Tang, Singapore (SG)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/087,892

(22) Filed: Mar. 23, 2005

(51) Int. Cl.[7] ..... H01Q 1/24
(52) U.S. Cl. ..... 343/702; 343/700 MS; 343/846
(58) Field of Search ..... 343/702, 700 MS, 343/846, 848; H01Q 1/24

(56) References Cited

U.S. PATENT DOCUMENTS 5,550,554 A * 8/1996 Erkocevic ..... 343/828
6,255,994 B1 * 7/2001 Saito ..... 343/700 MS
6,462,714 B1 * 10/2002 Okabe et al. ..... 343/767
2004/0090372 A1 * 5/2004 Nallo et al. ..... 343/700 MS

* cited by examiner

*Primary Examiner*—Hoanganh Le
(74) *Attorney, Agent, or Firm*—Randall S. Vaas

(57) ABSTRACT

A radio communications device (100) having an antenna radiator assembly (19) has radio frequency communications circuitry (2), a ground plane (40), a radio frequency radiator element (7) and connectors each physically contacting the radio frequency radiator element (7) at contact points. A feed point (30) formed by one of the connectors couples the radio frequency radiator element (7) to the radio frequency communications circuitry (2). Grounds links (32, 36*a*, 36*b*, 36*c*) formed the connectors selectively couple the radio frequency radiator element (7) to the ground plane (40) via a switching unit (22). When operating in a specific frequency band during a transmit mode, the switching unit (22) selects one the connectors to provide a transmit frequency sub-band, and when operating in the specific frequency band during a receive mode, the switching unit selects another of the connectors to provide a receive frequency sub-band.

19 Claims, 8 Drawing Sheets

ANTENNA RADIATOR ASSEMBLY AND RADIO COMMUNICATIONS DEVICE

FIELD OF THE INVENTION

This invention relates to an antenna radiator assembly and radio communications device including an antenna radiator assembly. The invention is particularly useful for, but not necessarily limited to, multi-band wireless communication devices with internal antennas.

BACKGROUND ART

Wireless communication devices often require multi-band antennas for transmitting and receiving radio communication signals often called Radio Frequency (RF) signals. For example, network operators providing service on a GSM system in a 900 MHz frequency band typically used in Asia also use a DCS system in a 1800 MHz frequency band typically used in Europe. Accordingly, GSM wireless communication devices, such as cellular radio telephones, should have dual band antennas to be able to effectively communicate at least at both of these frequencies. Also, in certain countries service providers operate on 850 MHz or 1900 MHz frequency bands.

Current consumer requirements are for compact wireless communication devices that typically have an internal antenna instead of an antenna stub that is visible to the user. Small cellular telephones now require a miniaturized antenna comprising an antenna radiator structure coupled to a ground plane, the ground planes being typically formed on or in a circuit board of the telephone. The antenna must be able to cover multiple frequency bands to, for instance, accommodate the 850 MHz, 900 MHz, 1800 Mhz and 1900 Mhz bands whilst being compact.

Internal antenna radiator structures, using a radiator element in the form of a micro-strip internal patch antenna, are considered advantageous in several ways because of their compact lightweight structure, which is relatively easy to fabricate and produce with precise printed circuit techniques or metal stamping techniques capable of integration on printed circuit boards. Most known internal patch antennas tend to have a narrow bandwidth, unless a thick but low permittivity and low conductivity dielectric substrate or mount is employed. The resulting thick substrate or mount affects antenna characteristics and limits their use in many applications, particularly in handheld mobile communication devices with severe space and weight constraints.

Conventional patch antenna assemblies have natural resonant frequencies or modes for RF and microwave applications. However, there are shortcomings when using natural resonant frequencies for antenna assemblies as they are dependent upon at least the following antenna assembly factors a) the shape and dimensions of the patch; b) the shape and dimensions of the ground plane; c) the location of the feed point contact on the patch; d) the location of the ground plane contact on the patch. Once the above factors are fixed, the resonant frequencies for the antenna assembly are also fixed. It is therefore difficult to provide a compact and economic multi-band antenna assembly more specifically a quad-band antenna assembly, using a single patch antenna (or any antenna formed from a conductive sheet) for use in a radio communications device. Also, multi-band patch antennas have a common effective length for both transmit and receive modes within an operating band that can compromise antenna efficiency.

In this specification, including the claims, the terms 'comprises', 'comprising' or similar terms are intended to mean a non-exclusive inclusion, such that a method or apparatus that comprises a list of elements does not include those elements solely, but may well include other elements not listed.

SUMMARY OF THE INVENTION

According to one aspect of the invention there is provided a radio communications device comprising radio frequency communications circuitry, a ground plane, a radio frequency radiator element, a plurality of connectors each physically contacting the radio frequency radiator element at contact points. The radio communications device also has: at least one feed point formed by one of the connectors, the feed point electrically coupling the radio frequency radiator element to the radio frequency communications circuitry; at least one ground link formed by one of the connectors electrically coupling the radio frequency radiator element to the ground plane; and at least one switching unit associated with the radio frequency communications circuitry and at least one of the connectors. When the device is operating in a specific frequency band during a transmit mode, the switching unit selects at least one of contact points of the connectors to provide a transmit frequency sub-band, and when the device is operating in the specific frequency band during a receive mode, the switching unit selects another at least one of the contact points of the connectors to provide a receive frequency sub-band.

According to another aspect of the invention there is provided an antenna radiator assembly comprising radio frequency communications circuitry, a ground plane, a radio frequency radiator element, a plurality of connectors each physically contacting the radio frequency radiator element at contact points, the connectors proving for coupling the frequency radiator element to the radio frequency communications circuitry and the ground plane. The antenna radiator assembly also has at least one switching unit associated with the radio frequency communications circuitry, the switching unit selectively controlling the coupling, wherein when the assembly is operating in a specific frequency band during a transmit mode, the switching unit selects at least one of contact points of the connectors to provide a transmit frequency sub-band, and when the assembly is operating in the specific frequency band during a receive mode, the switching unit selects another at least one of the contact points of the connectors to provide a receive frequency sub-band.

BRIEF DESCRIPTION OF THE DRAWINGS

In order that the invention may be readily understood and put into practical effect, reference will now be made to exemplary embodiments as illustrated with reference to the accompanying drawings in which.

DETAILED DESCRIPTION

Figure 1:
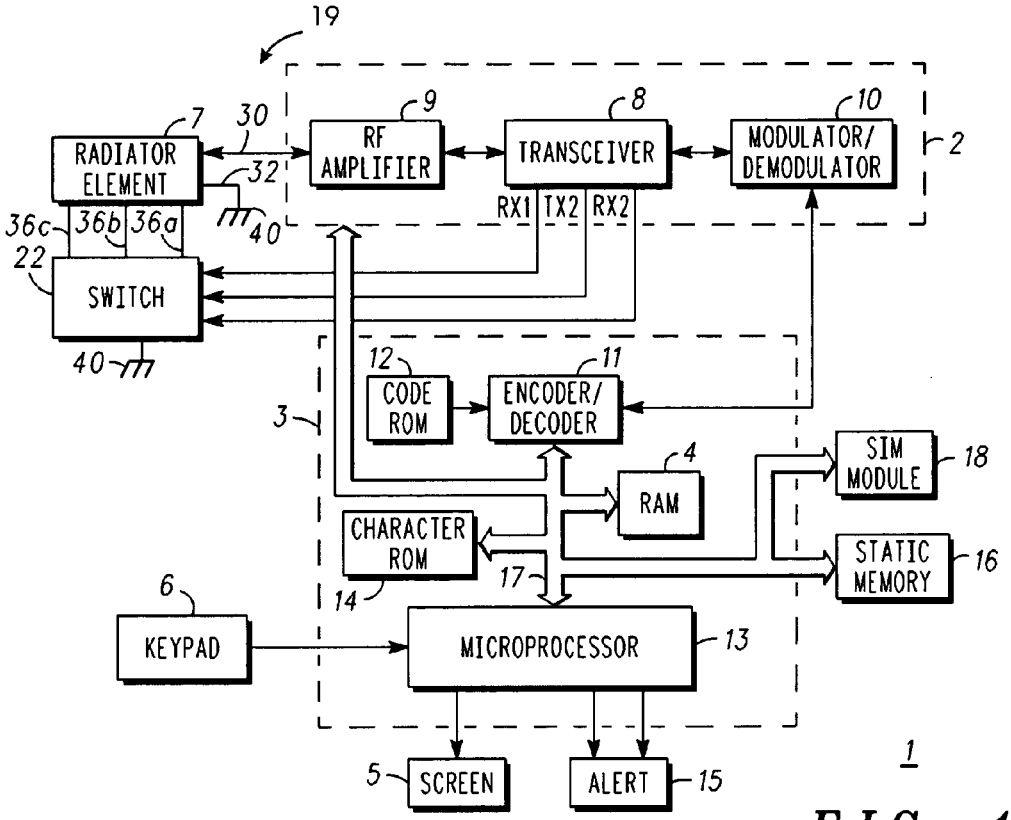
FIG. 1 is a block diagram of a first embodiment of a radio communications device including an antenna radiator assembly in accordance with the present invention.

In the drawings, like numerals on different Figs are used to indicate like elements throughout. With reference to FIG. 1, there is illustrated a first exemplary embodiment of a radio communications device in the form of a radio telephone 1 comprising radio frequency communications circuitry 2 coupled to be in communication with a processor 3. An input interface in the form of a screen 5 and a keypad 6 are also coupled to be in communication with the processor 3. As will be apparent to a person skilled in the art the screen 5 can be a touch screen thereby eliminating the need for the keypad 6.

The processor 3 includes an encoder/decoder 11 with an associated Read Only Memory (ROM) 12 storing data for encoding and decoding voice or other signals that may be transmitted or received by the radio telephone 1. The processor 3 also includes a micro-processor 13 coupled, by a common data and address bus 17, to the radio frequency communications circuitry 2, encoder/decoder 11, a character Read Only Memory (ROM) 14, a Random Access Memory (RAM) 4, a static programmable memory 16 and a removable Subscriber Identity Module (SIM) 18. The static programmable memory 16 and SIM 18 each can store, amongst other things, selected incoming text messages and a telephone book database.

The micro-processor 13 has ports for coupling to the keypad 6, the screen 5 and an alert module 15 that typically contains a speaker, vibrator motor and associated drivers. The character Read only memory 14 stores code for decoding or encoding text messages that may be received by the communication circuitry 2, input at the keypad 6. In this embodiment the character Read Only Memory 14 also stores operating code (OC) for micro-processor 13. As will be apparent to a person skilled in the art the radio telephone 1 also has a speaker and microphone and other components (not shown).

The radio frequency communications circuitry 2 is has a transceiver 8 coupled to both a radio frequency amplifier 9 and a combined modulator/demodulator 10. There is also illustrated a radio frequency radiator element 7 that is coupled to the radio frequency amplifier 9 by a single feed point 30. Thus, the feed point 30 provides for electrically coupling the radio frequency radiator element 7 to the radio frequency communications circuitry 2. There is also a ground connector (first ground link) 32, a second ground connector (second ground link) 36*a*, a third ground connector third ground link 36*b*, a fourth ground connector (fourth ground link) 36*c* and a switching unit 22. It should be clearly understood that in this specification the term ground connector can be interchangeable with ground link. The switching unit 22 is coupled to, and operatively controllable by, the transceiver 8 that forms part of the radio communications circuitry 2. The first ground connector 32 provides for electrically coupling the radio frequency radiator 7 to a ground plane 40 and the second, third and fourth ground connectors 36*a*, 36*b*, 36*c* provide for selectively electrically coupling to the radio frequency radiator element 7 to the ground plane 40 through the switching unit 22. The radio frequency communications circuitry 2, ground plane 40, radio frequency radiator 7, feed point 30, switching unit 22, the first ground connector 32 and second ground connector form at least part of an antenna radiator assembly 19.

Figure 2:
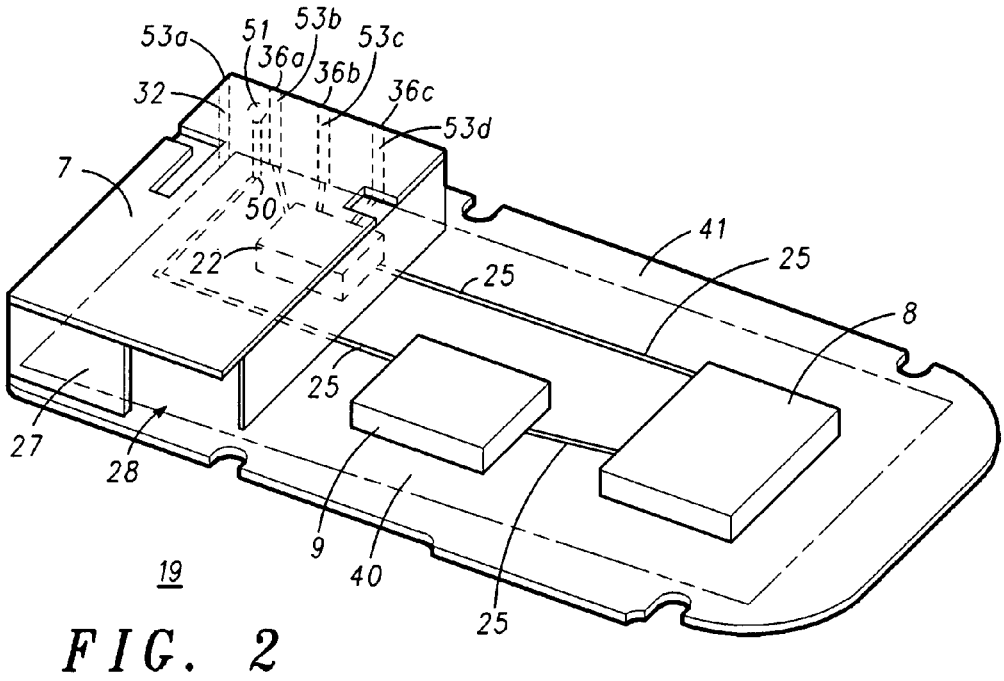
FIG. 2 is perspective view of the antenna radiator assembly of a first embodiment in accordance with the invention.

Referring to FIG. 2 there is illustrated a first preferred embodiment of the antenna radiator assembly 19 comprising a circuit board 41 supporting the radio frequency amplifier 9, the transceiver 8, switching unit 22 and a conductive plate (shown in phantom due to it being sandwiched in circuit board 41) providing part of the ground plane 40. There are also other typical components/modules (not shown for clarity) and other conductive plates combined forming the ground plane 40 that are mounted to or electrically coupled the circuit board 41. The radio frequency radiator element 7 is coupled to the transceiver 8 unit 2 through: a) the feed point 30, is formed by a connector in the form of a spring loaded feed point pin 50 (shown in phantom); b) the radio frequency amplifier 9; and c) runners 25 (most runners on circuit board 41 are not shown). As illustrated, a connector (spring loaded feed point pin 50) providing the feed point 30 is physically contacting the radio frequency radiator element 7 at a feed contact point 51 of the radio frequency radiator element 7. Also, as will be apparent to a person skilled in the art, the feed point 30 can be other than a spring loaded fed point, and it could be replaced with a capacitive, or more inductive coupling techniques.

The radio frequency radiator element 7 is also directly coupled to the ground plane 40 by the first ground connector 32 (shown in phantom). As illustrated, the first ground connector 32 is electrically coupling the radio frequency radiator element 7 at a first ground contact point 53*a* of the radio frequency radiator element 7. Further, the second, third and fourth ground connectors (ground links) 36*a*, 36*b*, 36*d* (shown in phantom), provide for selectively electrically coupling to the radio frequency radiator element 7 to the ground plane 40 through the switching unit 22. More specifically, the second ground connector 36*a* provides for electrically coupling of the radio frequency radiator element 7 to the ground plane 40 at a second ground contact point 53*b* of the radio frequency radiator element 7. The third ground connector 36*c* provides for electrically coupling of the radio frequency radiator element 7 to the ground plane 40 at a third ground contact point 53*c* of the radio frequency radiator element. Also, the fourth ground connector 36*d* provides for electrically coupling of the radio frequency radiator element 7 to the ground plane 40 at a fourth ground contact point 53*d* of the radio frequency radiator element. Each of the ground connectors 36*a*,36*b*,36*c* are coupled to the switching unit 22 by runners 25 and as will be apparent to a person skilled in the art the length of the runners 25 connecting the ground connectors 36*a*,36*b*,36*c* to the ground plane 40 must as short as possible.

The radio frequency radiator element 7 is mounted to a dielectric mount 27 in the form housing 27 (typically formed from a dielectric plastics material) for housing a resonator cavity 28 within which typically resides a speaker (not shown).

Figure 3:
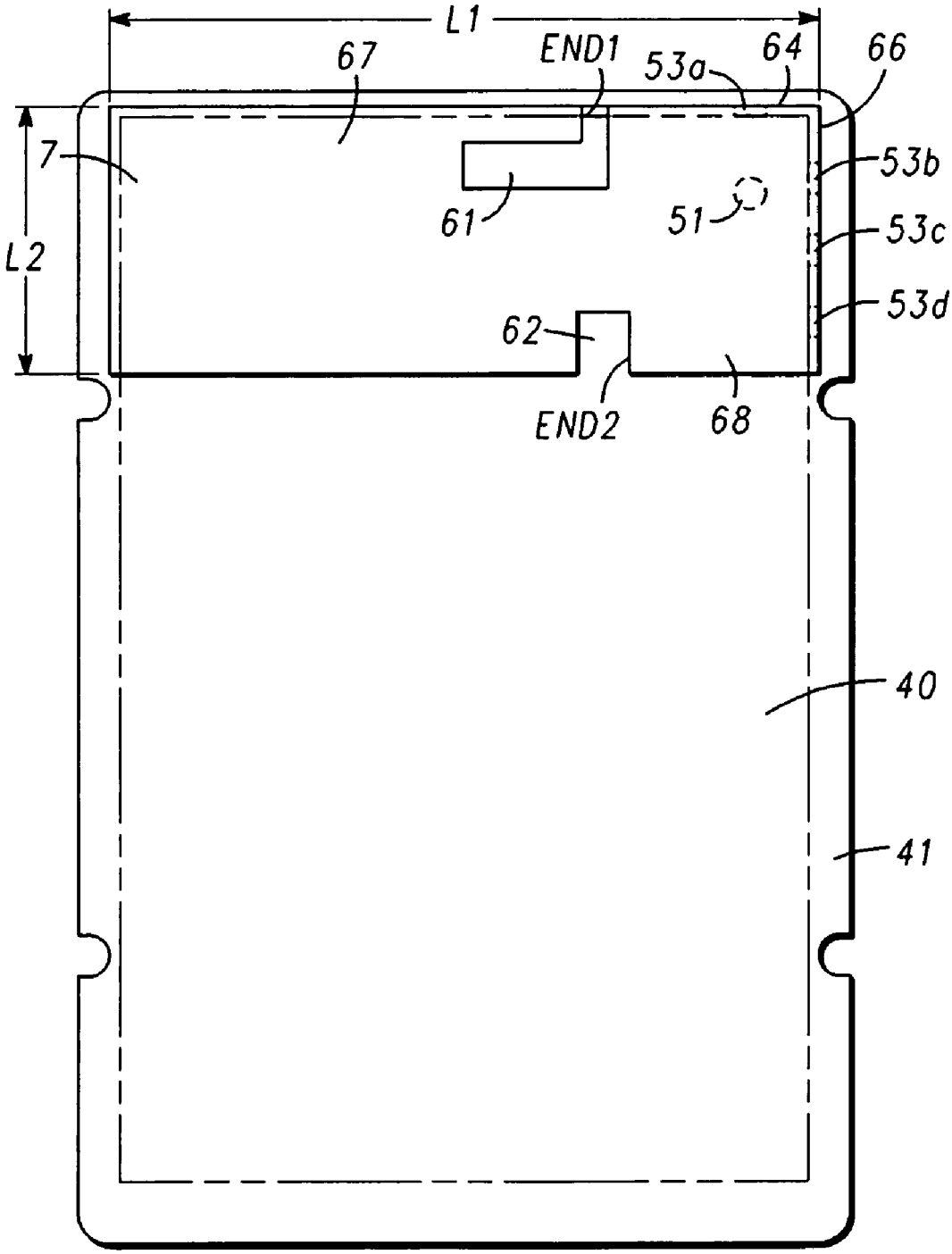
FIG. 3 is a plan view of part of the antenna radiator assembly of FIG. 2.
Figure 4:
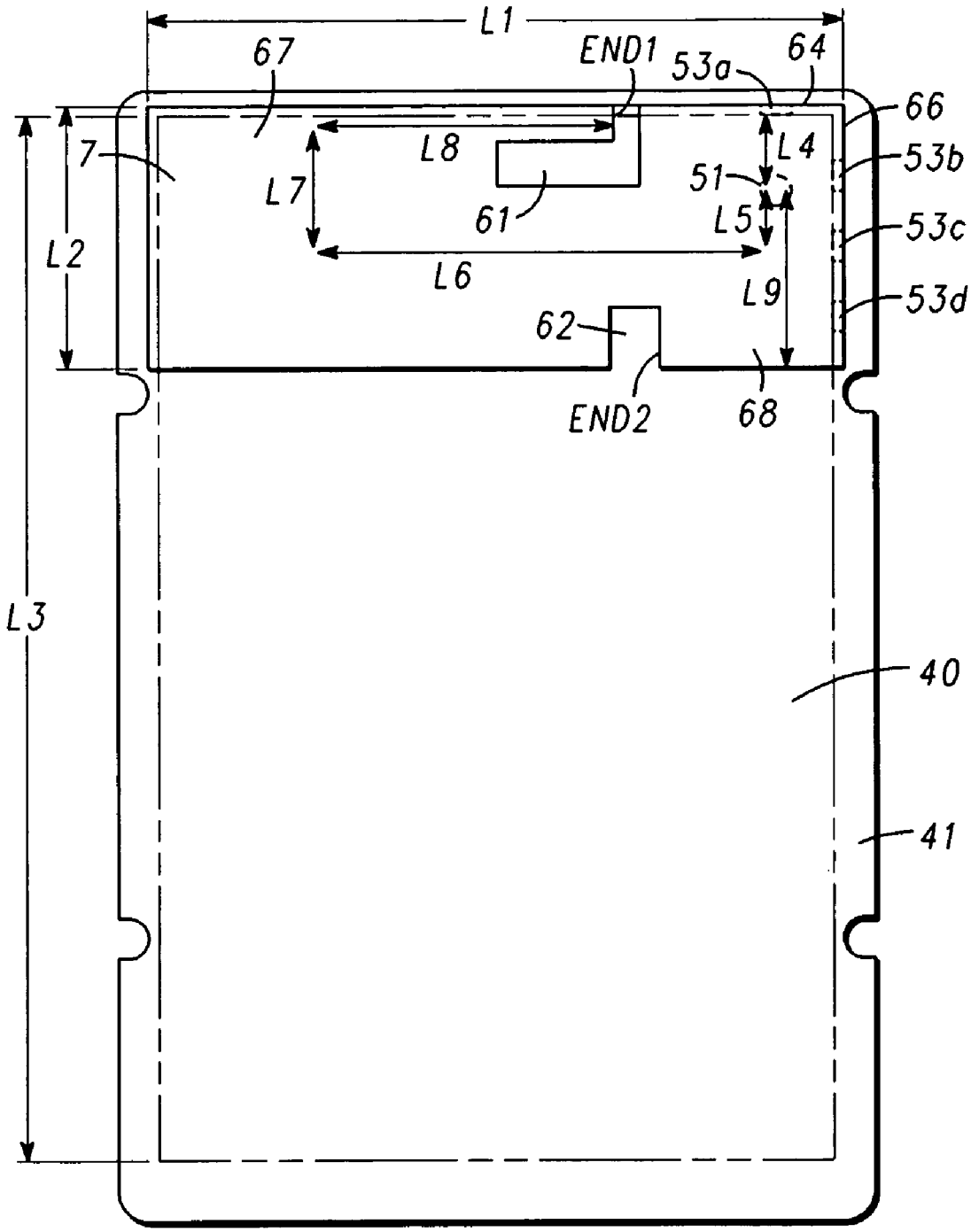
FIG. 4 is a plan view of part of the antenna radiator assembly of FIG. 2 illustrating effective lengths of a ground plane and radiator element lengths.
Figure 5:
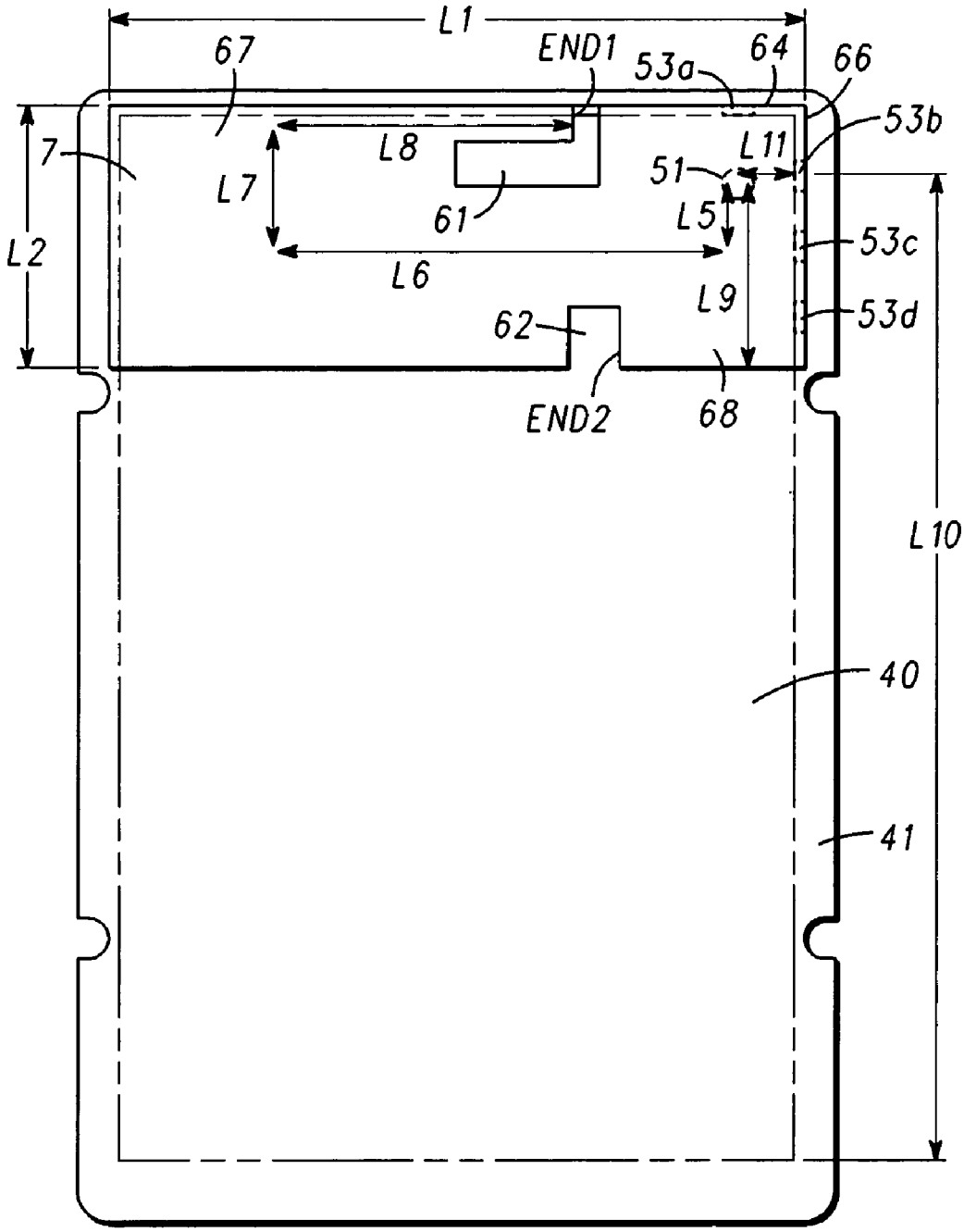
FIG. 5 is a plan view of part of the antenna radiator assembly of FIG. 2 illustrating further effective lengths of the ground plane and radiator element lengths.
Figure 6:
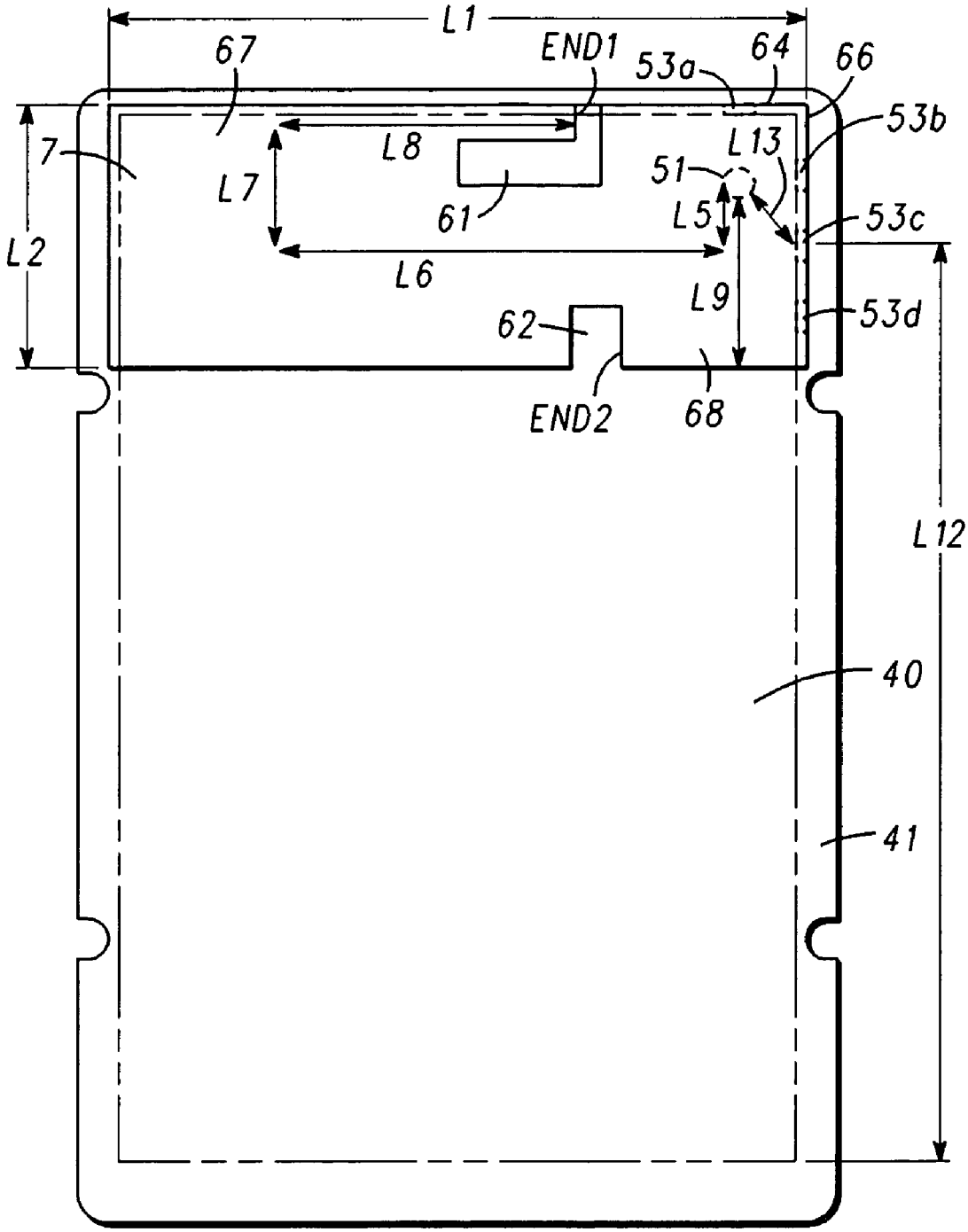
FIG. 6 is a plan view of part of the antenna radiator assembly of FIG. 2 illustrating yet further effective lengths of the ground plane and radiator element lengths.
Figure 7:
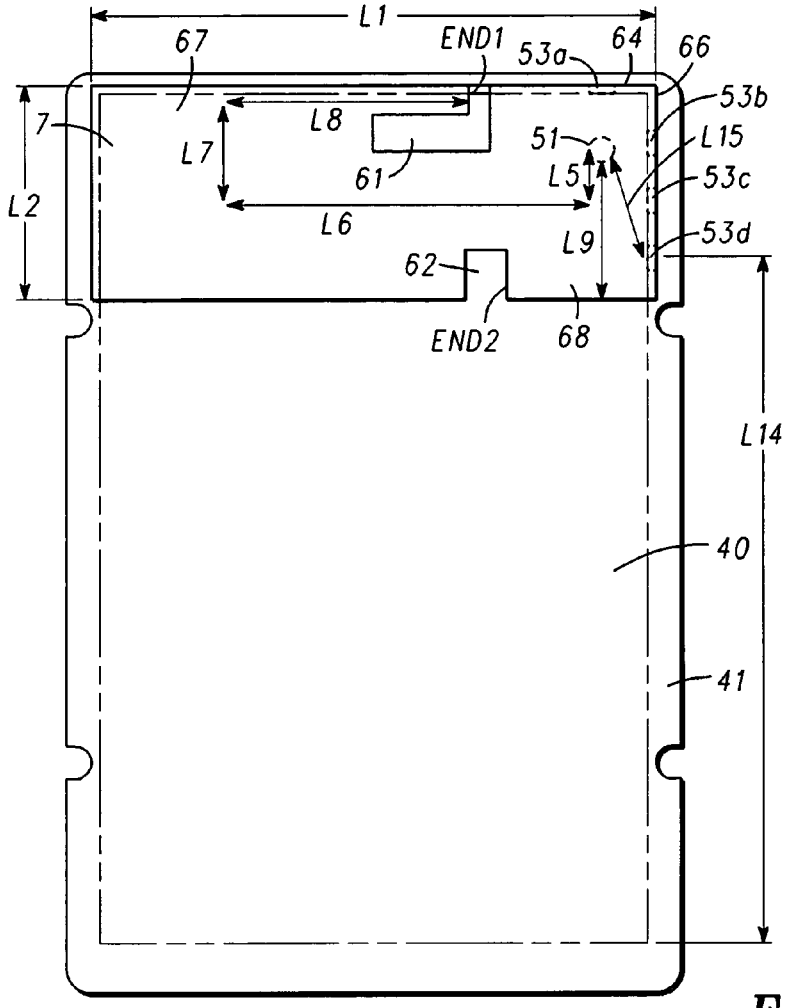
FIG. 7 is a plan view of part of the antenna radiator assembly of FIG. 2 illustrating more effective lengths of the ground plane and radiator element lengths.

Referring to FIG. 3, part of the first preferred embodiment of the antenna radiator assembly 19 is shown in plan view. As illustrated, the radio frequency radiator element 7 is typically formed from flat planar conductive copper sheet, of a length L1 and width L2, with slots therein. In this specific embodiment the radio frequency radiator element 7 has two slots 61, 62 that form two radiator element portions 67, 68 (described in more detail later) having respective open circuit ends at the approximate locations END1 and END2 Also, the first ground contact point 53*a* is proximal to a first edge 64 of the radio frequency radiator element 7. Similarly, the second, third, and fourth ground contact points 53*b*, 53*c*, 53*d* are proximal to a second edge 66 of the radio frequency radiator element 7.

The feed contact point 51 and the second, third and fourth ground contact points 53*b*, 53*c*, 53*d* are coupled at respective locations on the radio frequency radiator element 7 so that when any one of the second third and fourth ground contact points 53*b*, 53*c*, 53*d* selectively couples the radio frequency radiator element to the ground plane 40 through the switching unit 22, the impedance of the radiator element is substantially impedance matched to the radio frequency communications circuitry 8. This is essentially achieved by impedance matching circuitry in the radio frequency amplifier 9. Further, the feed contact point 51 and first ground contact point 53*a* are coupled at respective locations on the radio frequency radiator element 7 so that when the second third and fourth ground connectors 36*a*, 36*b*, 36*c* are electrically isolated from the ground plane 40, by the switching unit 22, and the first ground connector is electrically coupling the active radiator element 7 to the ground plane 40. When so coupled, the impedance of the radio frequency radiator element 7 is substantially impedance matched to the radio frequency communications circuitry 8.

In this exemplary embodiment, the first ground connector 32 provides a permanent electrical coupling of the radiator element 7 to the ground plane 40. When any one of the second, third or fourth ground connectors 36*a*,36*b*,36*c* electrically couple the radio frequency radiator element to the ground plane 40 through the switching unit 22, the first ground connector also electrically couples radio frequency radiator element 7 to the ground plane 40. As will be apparent to a person skilled in the art, the selective switching of the second, third or fourth ground connectors 36*a*, 36*b*, 36*c* provides for a lower impedance (shorter effective length) to the ground plane 40 than that of the first ground connector 32 and thus the first ground connector 32 does not need to be coupled to the ground plane 40 through the switching unit 22.

Referring to FIGS. 4 to 7 there is illustrated plan views of part of the antenna radiator assembly 19 identifying effective lengths of the ground plane 40. In these illustrations, when the second, third and fourth ground connectors 36*a*, 36*b*, 36*c* are electrically isolated from the ground plane 40 by the switching unit 22, the ground plane 40 has a longer effective length L3 than an effective length L10, L12 or L14 when one the second, third or fourth ground connectors 36*a*, 36*b* or 36*c* are electrically coupled to the ground plane by the switching unit 22. Also, when the ground connectors 36*a*, 36*b* or 36*c* are electrically isolated from the ground plane 40, an effective length L4 between the feed contact point 30 and the ground plane 40 is increased compared to an effective length L11 when the second ground connector 36*a* is electrically coupled to the ground plane 40 by the switching unit 22. However, when the third ground connector 36*b* electrically coupled to the ground plane 40 an effective length L13 between the feed contact point 30 and the ground plane 40 is increased relative to the effective lengths L4 and L11. Similarly, when the fourth ground connector 36*c* electrically coupled to the ground plane 40 an effective length L15 between the feed contact point 30 and the ground plane 40 is increased relative to the effectives length L4, L11 and L13.

The slots in the radio frequency radiator element 7 provides for the two radiator element portions 67,68 with their respective open circuit ends at the approximate locations END1 and END2. When the ground connectors 36*a*, 36*b* and 36*c* are electrically isolated from the ground plane 40 the radiator element portion 67 has a radiator element length REL1=L4+L5+L6+L7+L8; and the radiator element portion 68 has radiator element length REL2=L4+L9. When the second ground connector 36*a* is electrically coupled to the ground plane 40 the radiator element portion 67 has a radiator element length REL3=L11+L5+L6+L7+L8; and the radiator element portion 68 has radiator element length REL4=L11+L9. Also, when the third ground connector 36*b* is electrically coupled to the ground plane 40 the radiator element portion 67 has a radiator element length REL5=L13+L5+L6+L7+L8; and the radiator element portion 68 has radiator element length REL6= L13+L9. Further, when the fourth ground connector 36*c* is electrically coupled to the ground plane 40 the radiator element portion 67 has a radiator element length REL7=L15+L5+L6+L7+L8; and the radiator element portion 68 has radiator element length REL8=L15+L9.

It should be noted that in this specification, the antenna radiator element 7 is commonly known as a patch or internal antenna and this antenna can be totally enclosed inside a housing of the radio communications device 1. However, the antenna radiator element 7 may form part of a housing wall of the radio communications device 1.

Figure 8:
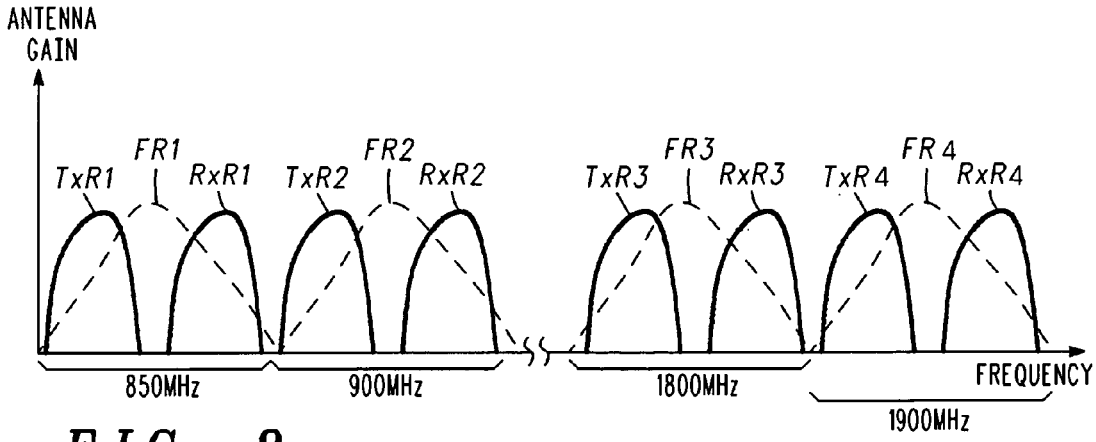
FIG. 8 illustrates a transmit and receive frequency response of the present invention.

As illustrated in FIG. 8, the first embodiment provides for four transmit frequency sub-bands and four receive frequency sub-bands in which the radiator element portions 67, 68 resonate at desired transmit frequency sub-bands or receive frequency sub-bands. More specifically, when the ground connectors 36*a*, 36*b*, 36*c* are electrically isolated from the ground plane 40, by the switching unit 22, the radio frequency radiator element 7 provides for:

a) a first transmit resonant frequency sub-band TXR1 in the approximate range of 824 MHZ to 849 MHZ when using the radiator element portion 67;

b) a third transmit resonant frequency sub-band TXR3 in the approximate range of 1710 MHZ to 1785 MHZ when using the radiator element portion 68.

When the second ground connector 36*a* is electrically coupled to the ground plane 40, by the switching unit 22, the radio frequency radiator element 7 provides for:

a) a first receive resonant frequency sub-band RXR1 in the approximate range of 869 MHZ to 890 MHZ when using the radiator element portion 67;

b) a third receive resonant frequency sub-band RXR3 in the approximate range of 1805 MHZ to 1880 MHZ when using the radiator element portion 68.

When the third ground connector 36*b* is electrically coupled to the ground plane 40, by the switching unit 22, the radio frequency radiator element 7 provides for:

a) a second transmit resonant frequency sub-band TXR2 in the approximate range of 880 MHZ to 915 MHZ when using the radiator element portion 67;

b) a fourth transmit resonant frequency sub-band TXR4 in the approximate range of 1850 MHZ to 1950 MHZ when using the radiator element portion 68.

When the fourth ground connector 36*c* is electrically coupled to the ground plane 40, by the switching unit 22, the radio frequency radiator element 7 provides for:

a) a second receive resonant frequency sub-band RXR2 in the approximate range of 925 MHZ to 960 MHZ when using the radiator element portion 67;

b) a fourth receive resonant frequency sub-band RXR4 in the approximate range of 1930 MHZ to 1990 MHZ when using the radiator element portion 68.

As can be seen in FIG. 8, the use of selecting effective lengths REL1 to REL8, associated with the resonating transmit sub-bands TXR1–TXR4 and resonating receive sub-bands RXR1–RXR4, provides for improved antenna efficiency compared with maintaining a common antenna effective length for both transmit and receive modes with a specific band. If a common effective length is used for both transmit and receive within a band then the antenna efficiency is shown by the frequency responses FR1,FR2,FR3, FR4 illustrated in phantom.

Figure 9:
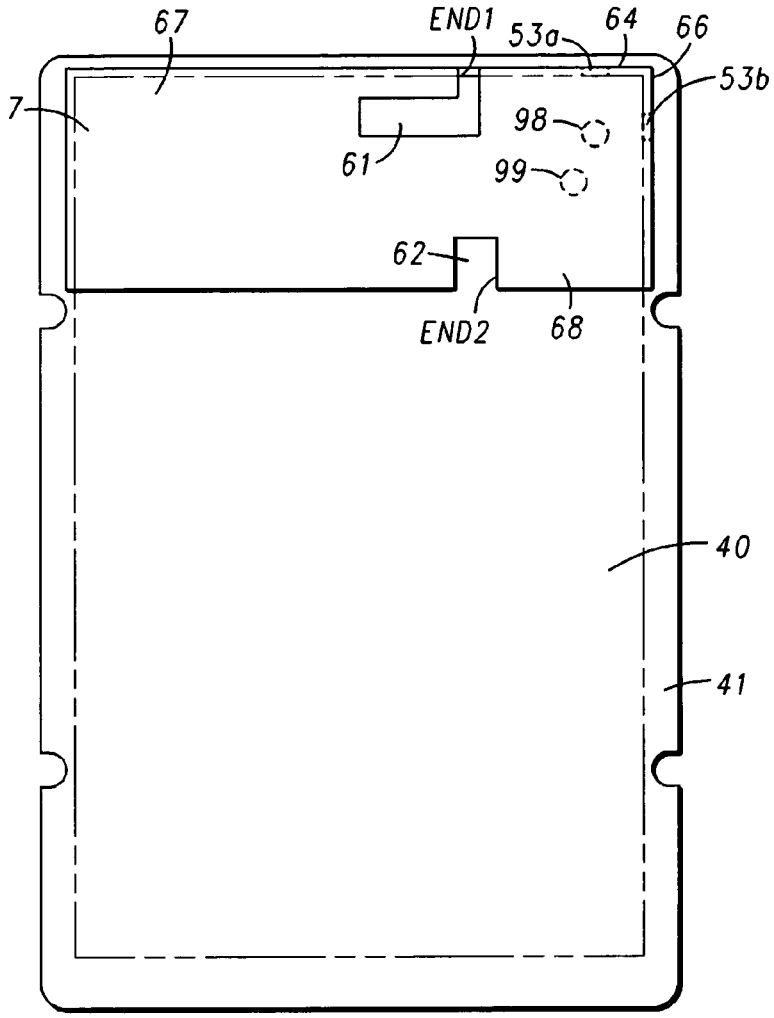
FIG. 9 is a plan view of a second embodiment of part of the antenna radiator assembly in accordance with the present invention.
Figure 10:
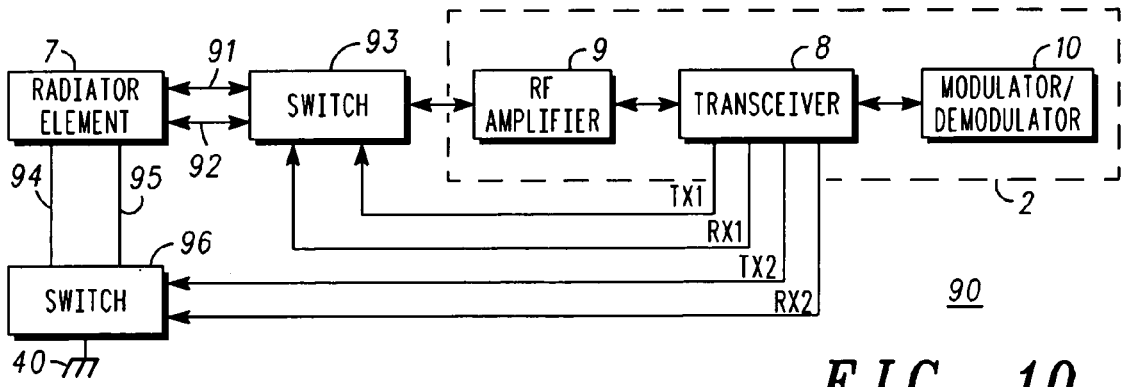
FIG. 10 is a block diagram further illustrating the second embodiment of part of the antenna radiator assembly in accordance with the present invention.

Referring to FIGS. 9 and 10 there is illustrated a second exemplary embodiment of an antenna radiator assembly 90 in which the radio frequency radiator element 7 is coupled to the radio frequency amplifier 9 by selection of a first and second feed point 91,92 by a switching unit 93. Thus, the feed points 91,92 provides for selectively electrically coupling the radio frequency radiator element 7, at respective feed contact points 98, 99, to the radio frequency communications circuitry 2. As shown, the first and second feed contact points 98, 99 are spaced from each other. The radio frequency radiator element 7 is also coupled to the ground plane 40, by selection of ground links 94, 95 by a switching unit 96, The ground links 94,95 contact the radiator element 7 at respective ground contact points 53*a*, 53*b*. The switching units 93,96 are coupled to, and operatively controllable by control lines TX1, TX2, RX1, RX2 from the transceiver 8 that forms part of the radio communications circuitry 2.

The radio frequency communications circuitry 2, ground plane 40, radio frequency radiator element 7, feed points 91, 92, ground links 94,95 switching units 93,96, form at least part of an antenna radiator assembly 90. Also, the ground link 94 has the first ground contact point 53*a* that is proximal to a first edge 64 of the radio frequency radiator element 90. Similarly, the ground link 95 has the ground contact point 53*b* proximal to a second edge 66 of the radio frequency radiator element 90. As will be apparent to a person skilled in the art, the antenna radiator assembly 90 can be included in the radio communications device 1 and functions in a similar manner to that of the antenna radiator assembly 19, thereby modifying the effective lengths of the radiator element portions 67, 68.

Figure 11:
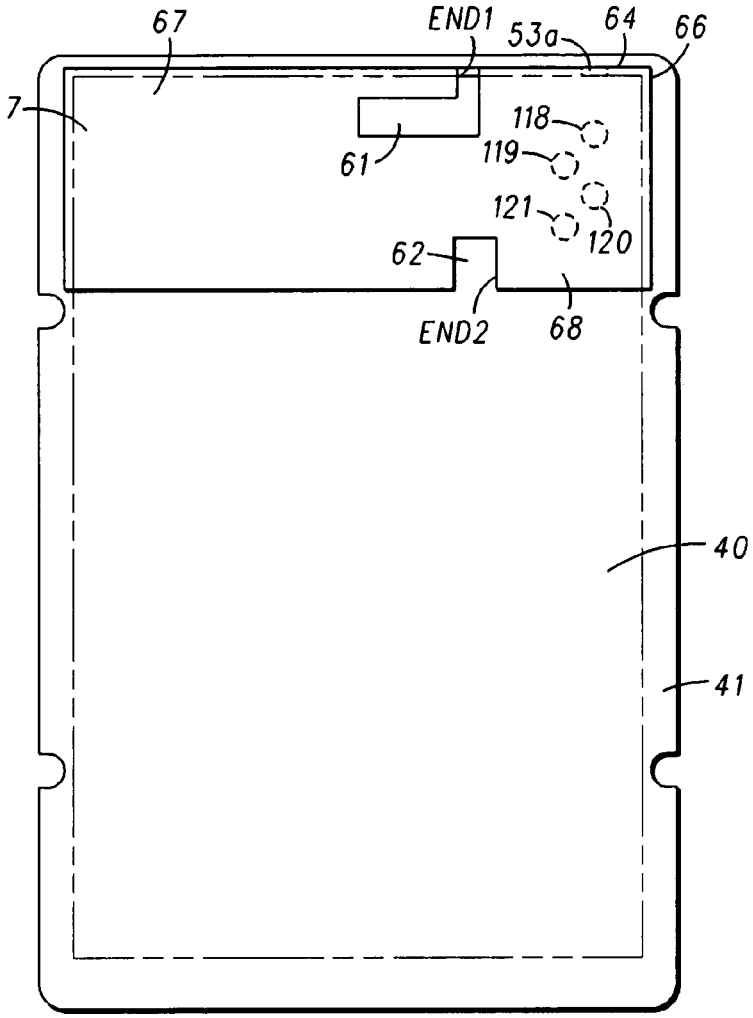
FIG. 11 is a plan view of a third embodiment of part of the antenna radiator assembly in accordance with the present invention.
Figure 12:
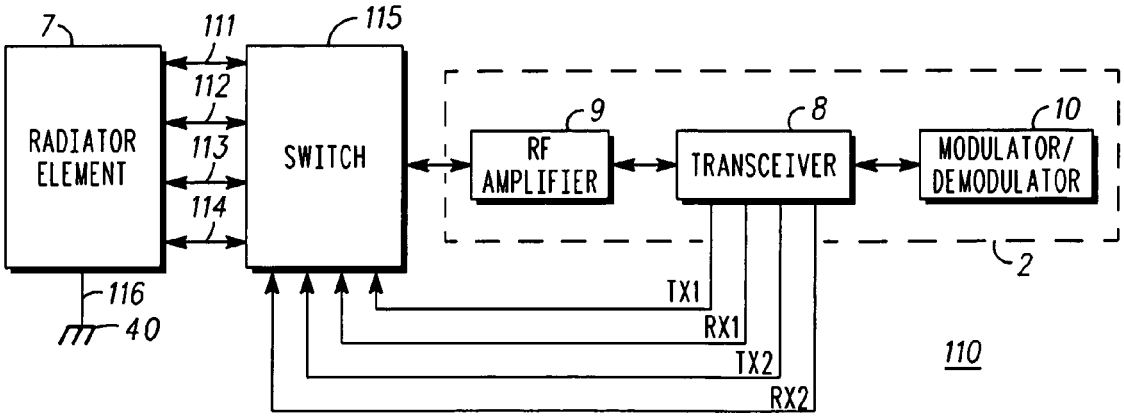
FIG. 12 is a block diagram further illustrating the third embodiment of part of the antenna radiator assembly in accordance with the present invention.

Referring to FIGS. 11 and 12 there is illustrated a third exemplary embodiment of an antenna radiator assembly 110 in which the radio frequency radiator element 7 is coupled to the radio frequency amplifier 9 by selection of feed points 111,112, 113,114 by a switching unit 115. Thus, the feed points 111,112,113,114 provides for selectively electrically coupling the radio frequency radiator element 7, at respective feed contact points 118,119,120,121, to the radio frequency communications circuitry 2. As shown, the feed contact points 118,119,120,121 are spaced from each other. The radio frequency radiator element 7 is directly coupled to the ground plane 40 by a single ground link 116. The ground links 116 contacts the radiator element 7 at the ground contact point 53*a*. Also, the switching unit 115 is coupled to, and operatively controllable by control lines TX1, TX2, RX1, RX2 from the transceiver 8 that forms part of the radio communications circuitry 2.

The radio frequency communications circuitry 2, ground plane 40, radio frequency radiator element 7, feed points 111,112, 113,114 ground link 116 switching unit 115, form at least part of an antenna radiator assembly 110. Again, as will be apparent to a person skilled in the art, the antenna radiator assembly 110 can be included in the radio communications device 1 and functions in a similar manner to that of the antenna radiator assembly 19, thereby modifying the effective lengths of the radiator element portions 67, 68.

Advantageously, the present invention provides a plurality of connectors forming the ground links (ground connectors) and the feed points each physically contacting the radio frequency radiator element 7 at the ground contact points and feed contacts points. Accordingly, when for instance the device 1 is operating in a specific frequency band during a transmit mode, the switching unit 22 selects at least one of contact points of the connectors to provide the transmit frequency sub-band. Also, when the device 1 is operating in the specific frequency band during a receive mode, the switching unit 22 selects another at least one of the contact points of the connectors to provide the receive frequency sub-band. The present invention therefore allows for improved antenna efficiency compared with maintaining a common antenna effective length for both transmit and receive modes within a specific band. Also, the present invention provides for a compact, multi-band (for instance quad-band) antenna radiator assembly and a radio communications device capable of operating at multiple specified bands.

The detailed description provides exemplary embodiments only, and is not intended to limit the scope, applicability, or configuration of the invention. Rather, the detailed descriptions of the exemplary embodiments provide those skilled in the art with an enabling description only. It should be understood that various changes may be made in the function and arrangement of elements without departing from the spirit and scope of the invention as set forth in the appended claims.

We claim:

1. A radio communications device comprising:

radio frequency communications circuitry;

a ground plane;

a radio frequency radiator element;

a plurality of connectors each physically contacting the radio frequency radiator element at contact points At least one feed point formed by one of the connectors, the feed point electrically coupling the radio frequency radiator element to the radio frequency communications circuitry;

At least one ground link formed by one of the connectors electrically coupling the radio frequency radiator element to the ground plane;

At least one switching unit associated with the radio frequency communications circuitry and at least one of the connectors, wherein when the device is operating in a specific frequency band during a transmit mode, the switching unit selects at least one of contact points of the connectors to provide a transmit frequency sub-band, and when the device is operating in the specific frequency band during a receive mode, the switching unit selects another at least one of the contact points of the connectors to provide a receive frequency sub-band.

2. A radio communications device, as claimed in claim 1, wherein the contact points of the least one ground link includes a first ground contact point proximal to a first edge of the radio frequency radiator element and a second ground contact point proximal to a second edge of the radio frequency radiator element.

3. A radio communications device, as claimed in claim 2, wherein the contact points of the at least one feed point includes a first feed contact point and second feed contact point spaced from the first feed contact point.

4. A radio communications device, as claimed in claim 3, wherein the first feed contact point and first second ground contact point are coupled at respective locations on the radio frequency radiator element so that when the second ground link selectively couples the radiator element to the ground plane through the switching unit, the impedance of the radio frequency radiator element is substantially impedance matched to the radio frequency communications circuitry.

5. A radio communications device, as claimed in claim 2, wherein the first feed contact point and second ground contact point are preferably coupled at respective locations on the radio frequency radiator element so that when the second ground link is electrically isolated from the ground plane by the switching unit, and the first ground link is electrically coupling the radio frequency radiator element to the ground plane, the impedance of the radiator element is substantially impedance matched to the radio frequency communications circuitry.

6. A radio communications device, as claimed in claim 3, wherein, the first ground link provides a permanent electrical coupling of the radio frequency radiator element to the ground plane, wherein when the second ground connector electrically couples the radio frequency radiator element to the ground plane through the switching unit, the first link connector also electrically couples radio frequency radiator element to the ground plane.

7. A radio communications device, as claimed in claim 3, wherein when the second ground link is electrically isolated from the ground plane by the switching unit, an effective length between the first feed contact point and the ground plane is increased compared to when the second ground connector is electrically coupled to the ground plane by the switching unit.

8. A radio communications device, as claimed in claim 2, wherein when the second ground link is electrically isolated from the ground plane by the switching unit, the ground plane has a longer effective length than when the ground link is electrically coupled to the ground plane by the switching unit.

9. A radio communications device, as claimed in claim 1, wherein the contact points of the at least one feed point includes a first feed contact point and second feed contact point spaced from the first feed contact point.

10. A radio communications device, as claimed in claim 1, wherein there is a single said feed point and there is more than one said ground link.

11. A radio communications device, as claimed in claim 1, wherein there is a single said ground link and there is more than one said feed point.

12. A radio communications device, as claimed in claim 1, wherein there is more than one said feed point and more than one said ground link.

13. A radio communications device, as claimed in claim 1, wherein the radiator element has at least two radiator element portions that resonate at a desired said transmit frequency sub-band or said receive frequency sub-band.

14. A radio communications device, as claimed in claim 13, wherein the radiator element is suitably formed from a conductive sheet with slots therein forming the radiator element portions.

15. A radio communications device, as claimed in claim 1, wherein an effective length at least one the radiator element varies when switching the switching unit selects at least one of the connectors.

16. An antenna radiator assembly comprising:

radio frequency communications circuitry;

a ground plane;

a radio frequency radiator element;

a plurality of connectors each physically contacting the radio frequency radiator element at contact points, the connectors proving for coupling the frequency radiator element to the radio frequency communications circuitry and the ground plane, at least one switching unit associated with the radio frequency communications circuitry, the switching unit selectively controlling said coupling, wherein when the assembly is operating in a specific frequency band during a transmit mode, the switching unit selects at least one of contact points of the connectors to provide a transmit frequency sub-band, and when the assembly is operating in the specific frequency band during a receive mode, the switching unit selects another at least one of the contact points of the connectors to provide a receive frequency sub-band.

17. An antenna radiator assembly, as claimed in claim 16, wherein the radiator element has at least two radiator element portions that can resonate at a desired said transmit frequency sub-band or said receive frequency sub-band.

18. An antenna radiator assembly, as claimed in claim 17, wherein radiator element is formed from a conductive sheet with slots therein forming the radiator element portions.

19. An antenna radiator assembly, as claimed in claim 16, wherein n effective length at least one the radiator element varies when the switching unit selects at least one of the connectors.

* * * * *